US009908176B2

(12) United States Patent
Koivisto et al.

(10) Patent No.: US 9,908,176 B2
(45) Date of Patent: Mar. 6, 2018

(54) CONTINUOUS CASTING NOZZLE ASSEMBLY FOR CASTING OF A METALLIC PIPE

(71) Applicant: Upcast Oy, Pori (FI)

(72) Inventors: Markku Koivisto, Pori (FI); Esko Furuholm, Pori (FI); Juha Jaakola, Pori (FI); Jukka Lähteenmäki, Pori (FI); Pertti Pihlajamäki, Pori (FI); Tuomas Rajaviita, Vanha-Ulvila (FI); Ismo Rossi, Pori (FI)

(73) Assignee: Upcast Oy, Pori (FI)

( * ) Notice: Subject to any disclaimer, the term of this patent is extended or adjusted under 35 U.S.C. 154(b) by 25 days.

(21) Appl. No.: 15/030,082

(22) PCT Filed: Oct. 18, 2013

(86) PCT No.: PCT/FI2013/050992

§ 371 (c)(1),
(2) Date: Apr. 18, 2016

(87) PCT Pub. No.: WO2015/055887

PCT Pub. Date: Apr. 23, 2015

(65) Prior Publication Data

US 2016/0236275 A1 Aug. 18, 2016

(51) Int. Cl.

| | |
|---|---|
| ***B22D 41/08*** | (2006.01) |
| ***B22D 41/50*** | (2006.01) |
| ***B22D 11/00*** | (2006.01) |
| ***B22D 11/14*** | (2006.01) |
| ***B22D 41/60*** | (2006.01) |

(52) U.S. Cl.

CPC ..... *B22D 41/50* (2013.01); *B22D 11/006* (2013.01); *B22D 11/145* (2013.01); *B22D 41/60* (2013.01)

(58) Field of Classification Search

CPC ..... B22D 11/006

See application file for complete search history.

(56) References Cited

U.S. PATENT DOCUMENTS

| | | | | |
|---|---|---|---|---|
| 3,229,005 | A * | 1/1966 | Reifenhausser | B29C 44/22 264/171.12 |
| 3,872,913 | A | 3/1975 | Lohikoski | |
| 4,546,816 | A * | 10/1985 | Schwarz | B22D 11/006 164/421 |

FOREIGN PATENT DOCUMENTS

| | | | |
|---|---|---|---|
| JP | 46-007055 | A | 6/1971 |
| JP | S5027032 | B1 | 9/1975 |
| JP | S5289413 | U | 7/1977 |
| JP | S63104762 | A | 5/1988 |

OTHER PUBLICATIONS

Japan Patent Office, Office Action issued in patent appln. No. 2016-548435 dated Jul. 12, 2017.

* cited by examiner

*Primary Examiner* — Scott R Kastler
(74) *Attorney, Agent, or Firm* — Berggren, Inc.

(57) ABSTRACT

The invention relates to a continuous casting nozzle assembly (10) for casting, in particular for upward vertical casting, of a metallic, in particular a non-ferrous, pipe, which is suitable for uninterrupted casting, which nozzle assembly comprises a nozzle (11), a mandrel (12) and a cooler (15). Surface roughness of at least part, in particular of the dwindling area (Z), of inner surface of the nozzle (11) of the nozzle assembly (10) is 1-8.0 Ra, advantageously 3-5 Ra.

13 Claims, 3 Drawing Sheets

CONTINUOUS CASTING NOZZLE ASSEMBLY FOR CASTING OF A METALLIC PIPE

Figure 1:
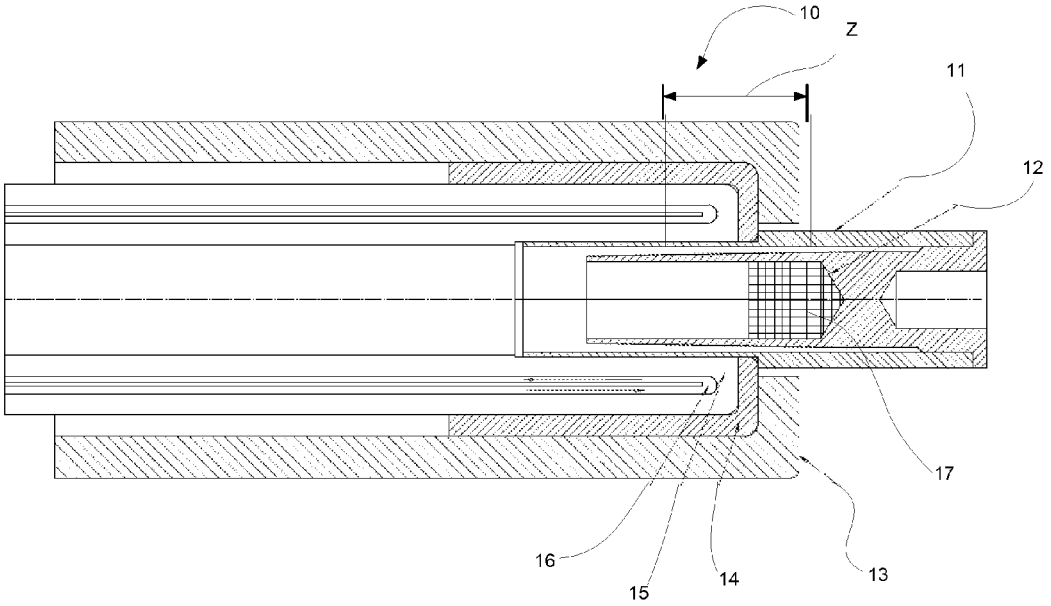

The invention relates to a continuous casting nozzle assembly for upward vertical casting of a non-ferrous, pipe, which is suitable for uninterrupted casting. Especially the invention relates to a continuous casting nozzle assembly for upward vertical casting of a non-ferrous pipe, which is suitable for uninterrupted casting, which nozzle assembly comprises a nozzle, a mandrel and a cooler.

The most traditional pipe manufacturing process involves first melting and casting a block, preheating and extruding the block, followed by Pilger rolling. An alternative is a Cast & Roll process, which involves melting of metal and horizontal casting a thick-walled pipe, followed by machining the pipe surface and planetary milling. These are highly complicated and hard-to-control processes.

A traditional arrangement for casting a pipe in continuous casting directed upwards from a free melt surface is disclosed for example in patent publication U.S. Pat. No. 3,872,913, which discloses a method and apparatus for the upwards casting of profiled products, wherein melt is sucked by means of a nozzle, establishing a mold above its surface and having its lower end immersed in the melt, and being connected at its upper end by way of a cooler-surrounded tube to a cooler support and to a source of vacuum. The cooler consists of three concentric tubes, between which extend cylindrical channels for cooling water. The innermost tube has a cross-section larger than that of the profiled pipe. The nozzle is constructed in a single piece of refractory material and extends by its upper end coaxially into the cooler. The cooler support has an opening that matches a pipe to be cast and, as the mold is connected with a further cooling zone more extensive than this, said source of vacuum enables sucking melt into the cooling zone present within the nozzle.

In JP S63104762 is disclosed a submerged nozzle for continuous casting by pouring molten metal into a tundish from a ladle and into a mold from the tundish, in which roughness before using at a part or all inner face containing discharging hole in the submerged nozzles is made to <=3.5.

Even though the nozzle assemblies according to prior art have been functioning well, a need for improved nozzle assembly, which is faultless in operation, has emerged as more effective casting equipment are needed to improve productivity of continuous casting facilities.

A problem with nozzle assemblies known from prior art is that various compounds of separating and/or filtering metals and/or alloying elements and/or oxygen may build up and deposit on the inner surface of a nozzle of the nozzle assembly upwards of the point at which the cross-section of a continuously cast pipe begins to dwindle because of casting contraction. Such compounds and particularly deposits thereof, hinder the casting process and may undermine the quality of a cast product. Such compounds or deposits are particularly susceptible to forming when the refractory nozzle material is graphite, which is otherwise an excellent mold material. The problems will become even more prominent should the metal to be cast be an actively reacting metal, such as aluminum or magnesium, or the metal to be cast is some extra pure alloy, such as oxygen-free copper.

Another problem that has occurred in the arrangements according to prior art is that in the continuous casting the grain size of the internal structure has been excessive and thus the internal composition of the casted pipe has been unfit for further shaping.

In prior art the above problems have been tried to be solved by polishing the inner surface of the nozzle of the nozzle assembly to correspond a mirror surface by honing, which is a time-consuming and thus expensive production step in nozzle assembly producing. This has not solved the problem to satisfactory level and building-up and depositing of various compounds onto the inner surface has caused problems in continuous casting of metallic pipes, in particular in upward casting of non-ferrous pipes.

An object of the invention is to create a continuous casting nozzle assembly, in which the problems and disadvantages of prior art have been eliminated or at least minimized.

An object of the invention is to create a continuous casting nozzle assembly for casting, in particular for upward vertical casting, of a metallic pipe, in particular a non-ferrous pipe, in which the disadvantages of known nozzle assemblies relating to building-up and depositing of various compounds of separating and/or filtering metals and/or alloying elements and/or oxygen on the inner surface of the nozzle of the nozzle assembly upwards of the point at which the cross-section of a continuously cast pipe begins to dwindle because of casting contraction.

An object of the invention is to create a continuous casting nozzle assembly for casting, in particular for upward vertical casting, of a metallic pipe, in particular a non-ferrous pipe, in which the disadvantages of known nozzle assemblies relating to excessive grain size has been solved.

An object of the invention is to provide a continuous casting nozzle assembly that is especially suitable for upward casting of non-ferrous pipes.

Further an object of the invention is to create an improved continuous casting nozzle assembly.

In order to achieve the above objects and those that will come apparent later the continuous casting nozzle assembly according to the invention is mainly characterized by continuous casting nozzle assembly for upward vertical casting of a non-ferrous pipe, which is suitable for uninterrupted casting, which nozzle assembly comprises a nozzle, a mandrel and a cooler, wherein surface roughness of at least part, in particular of the dwindling area, of an inner surface of the nozzle of the nozzle assembly is 3-5 Ra.

According to the invention the surface roughness of the inner surface of the nozzle of the nozzle assembly is 1-8.0 Ra, advantageously 3-5 Ra. Thus the inner surface is producible without honing by chipping, for example by drilling or by turning. When the inner surface roughness of the nozzle of the nozzle assembly is at the level according to the invention, harmful building-up and depositing of various compounds of separating and/or filtering metals and/or alloying elements and/or oxygen can be avoided.

According to an advantageous feature of the invention the inner surface of the nozzle is at the defined level on the inner surface of the nozzle upwards of the point at which the cross-section of a continuously cast pipe begins to dwindle because of casting contraction i.e. at dwindling area, which locates at the point where a cooler of the nozzle assembly begins to have an effect, which is about +/−22 mm from the point where the cooler begins to be seen from the direction of melt entrance. The surface roughness of the inner surface of the nozzle may be the same after the dwindling area or it may differ.

According to an advantageous feature openings for melt feed in the nozzle of the nozzle assembly are in an upward angle of 0-45°, advantageously 10-20°.

According to an advantageous feature openings for melt feed in the mandrel of the nozzle assembly are in an upward angle of 0-80°, advantageously 10-20°.

The angled openings for the melt feed of the nozzles and of the mandrel provide for better mixing of the melt and thus more homogenous melt is achieved and further a pipe with better quality is achieved.

According to an advantageous feature the openings for melt feed in the nozzle and in the mandrel are tangential, which directs flow of the melt to cooling zone and thus a better crystal structure is achieved.

According to an advantageous feature diameter of the openings for melt feed in the mandrel is greater than the diameter of the openings for melt feed in the nozzle, advantageously the diameter of the openings for melt feed in the mandrel is 10-100% greater, most advantageously 0.5 mm greater. The diameter of the openings for melt feed in the nozzle is advantageously 1.0-5.0 mm and the diameter of the openings for melt feed in the mandrel is advantageously 1.1-10.0 mm.

According to an advantageous feature the nozzle or the mandrel has no openings for melt feed and the melt is fed to cooling zone of the nozzle assembly only through the openings for melt feed in the mandrel or in the nozzle, correspondingly.

According to an advantageous feature in the nozzle there are 2-6, advantageously 3 openings for melt feed and in the mandrel there are 2-6, advantageously 3 openings for melt feed.

According to an advantageous feature the mandrel is conical and its angle of point is 0.5-3°, advantageously 2°. Advantageously the conical mandrel is tubular and thickness of the wall is 0.5-10 mm, more advantageously 2-4 mm.

According to an advantageous feature the cooler of the nozzle assembly is made of graphite or other ceramic material and the cooling zone has length of 40-400 mm, advantageously 80 mm. Advantageously the nozzle is tubular and the thickness of the wall, in particular in the cooling zone, is 0.5-4.0 mm, more advantageously 1.0-2.0 mm.

According to an advantageous feature HIP (high isostatic pressing) is used as production method for the cooler of the nozzle assembly.

By the optimized dimensioning considerable savings in material costs are achieved. In nozzle assembly production the material costs form significant part of the production costs.

According to an advantageous feature an isolating part is located at bottom of the mandrel in the nozzle assembly to interrupt the unfavorable effect of thermal radiation.

According to an advantageous feature the total length of the nozzle is 100-300 mm, advantageously 170 mm. The total length of the mandrel is advantageously 20-30% less than the length of the nozzle.

Advantageously in the nozzle assembly the nozzle and the cooler have a press-on fit abutment for fastening them to each other and thus the outer diameter of the nozzle is slightly greater than the inner diameter of the cooler.

Advantageously in the nozzle assembly the nozzle and the mandrel have a press-on fit abutment for fastening them to each other. To ensure the abutment between the nozzle and the mandrel a locking pin may be provided.

By the invention a nozzle assembly for continuous casting is achieved without problems relating to building-up or depositing of various compounds of separating and/or filtering metals and/or alloying elements and/or oxygen on the inner surface of the nozzle of the nozzle assembly upwards of the point at which the cross-section of a continuously cast pipe begins to dwindle because of casting contraction. By the invention also a nozzle assembly for continuous casting is achieved by which smaller grain size of the internal structure of the casted pipe is formed and thus further shaping properties of the pipe is significantly improved and for example sanitary tubes, industrial tubes and even thin wall ACR-tubes from copper and different alloys like for example CuNi can be produced. In addition an improved nozzle assembly, which is faultless in operation and more effective, is achieved and productivity of continuous casting facilities can be reached.

The continuous casting nozzle according to the invention is very suitable in casting pipes of non-ferrous materials, for example aluminum, copper, copper-nickel or copper-magnesium. The continuous casting nozzle according to the invention is advantageously used in upward casting but it can also be used in horizontal casting.

In the following the invention is described in more detail with reference to the accompanying drawing, in which an advantageous example of the invention is presented in details of which the invention is not to be narrowly limited.

In FIG. 1 is schematically shown in longitudinal side projection one advantageous example of a nozzle assembly according to the invention, In FIGS. 2A-2D are schematically shown advantageous examples the parts of the nozzle assembly according to FIG. 1.

In the following description with same reference signs are denoted same or corresponding parts or components unless otherwise mentioned.

Figure 2A:
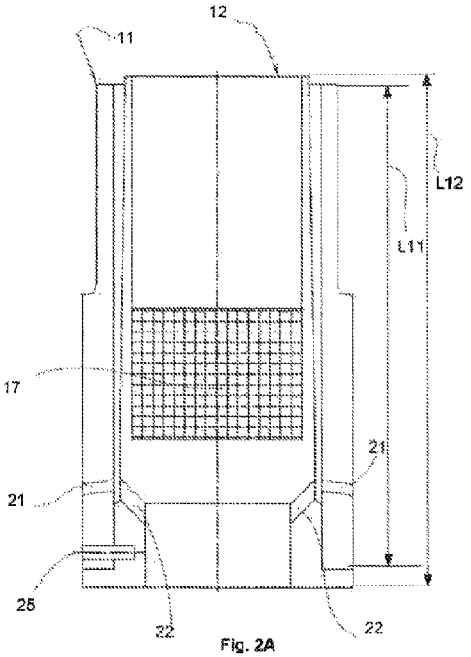
Figure 2B:
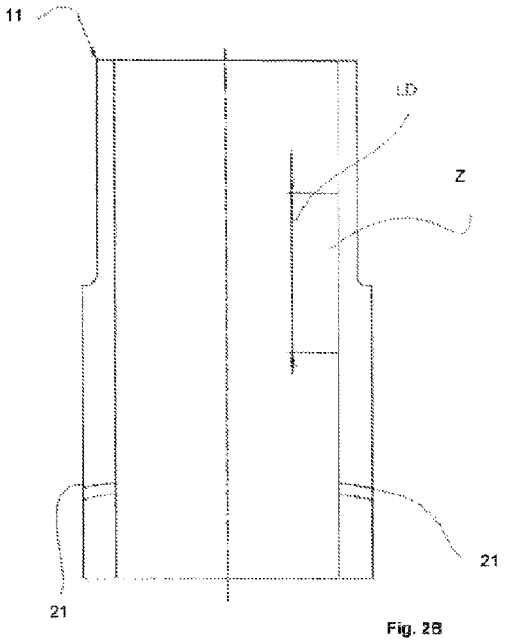
Figure 2C:
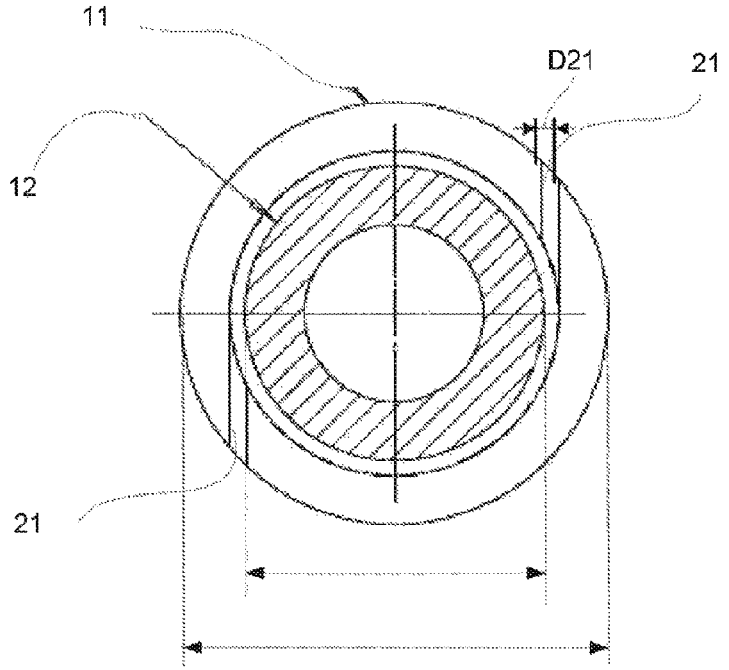
Figure 2D:
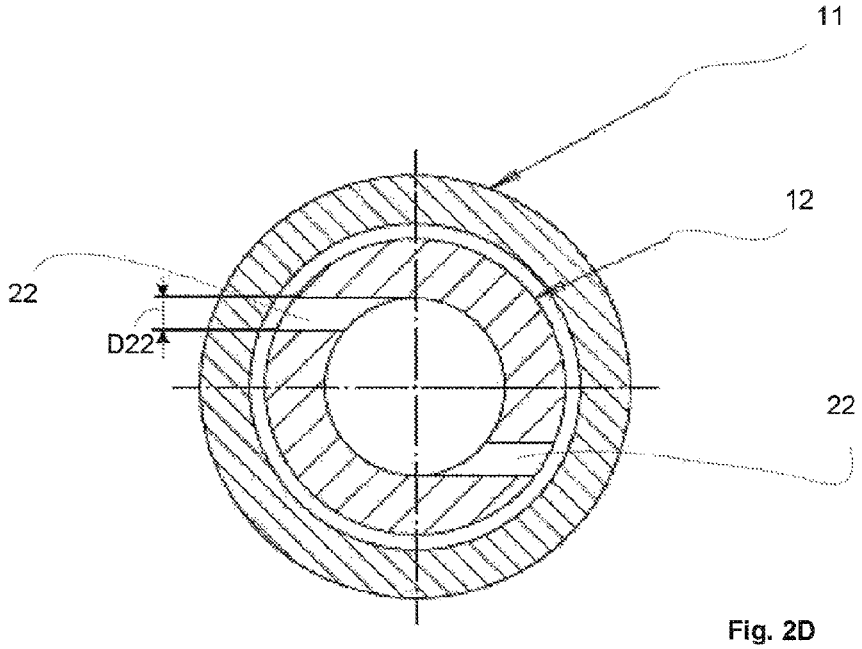

In the example of FIG. 1 the nozzle assembly 10 comprises a nozzle 11, a mandrel 12, a protective pot 13, an isolator 14, a cooler 15 and a cooling liquid space 16. The nozzle 11 is a tubular part inside of which at the feed end the tubular mandrel 12 for creating the middle opening of the pipe to be casted is located. Around the outlet end of the nozzle 11 the cooler 15 with the cooling liquid space is located thus forming the cooling zone. At the beginning of the cooling zone the dwindling area Z at which the cross-section of a continuously cast pipe begins to dwindle because of casting contraction is located. According to the invention advantageously at least the dwindling area Z of the inner surface of the nozzle 11 of the nozzle assembly 10 has a surface roughness of 1-8.0 Ra, advantageously of 3-5 Ra. Around the cooler 15 the isolator 14 is located around which the protective pot 16 is located. Another isolating part 17 is located at the bottom of the mandrel 12. In the example of FIG. 2A in the longitudinal side projection the nozzle 11 and the mandrel 12 of the nozzle assembly are shown. The nozzle 11 comprises openings 21 for melt feed and the mandrel 12 comprises openings 22 for the melt feed. At the bottom of the mandrel 12 the isolating part 17 is located. In the example of FIG. 2B in the longitudinal side projection the nozzle 11 is shown. The total length L11 of the nozzle 11 is 100-300 mm, advantageously 170 mm. The total length L12 of the mandrel 12 is advantageously 20-30% less than the length L11 of the nozzle 11. As shown in FIGS. 2A-2B the openings 21 for melt feed in the nozzle 11 of the nozzle assembly 10 are in an upward angle of 0-45°, advantageously 10-20° and the openings 22 for melt feed in the mandrel 12 of the nozzle assembly 10 are in an upward angle of 0-80°, advantageously 10-20°. At the beginning of the cooling zone of the nozzle 11 the dwindling area Z at which the cross-section of a continuously cast pipe begins to dwindle because of casting contraction is located and the surface roughness of the dwindling area Z is 1-8.0 Ra, advantageously of 3-5 Ra. In the examples of FIGS. 2C-2D cross-sectional end projections are shown of the nozzle 11 and the mandrel 12 and the openings 21, 22 for melt feed in the nozzle 11 and in the mandrel 12 are tangential. The diameter D22 of the openings 22 for melt feed in the mandrel 12 is greater than the diameter D21 of the openings 21 for melt feed in the nozzle 11, advantageously the diameter D22 of the openings 22 for melt feed in the mandrel 12 is 10-100% greater, most advantageously 0.5 mm greater. The diameter D21 of the openings 21 for melt feed in the nozzle 11 is advantageously 1.0-5.0 mm and the diameter D22 of the openings 22 for melt feed in the mandrel 12 is advantageously 1.1-10.0 mm. In the nozzle 11 there are 2-6, advantageously 3 openings 21 for melt feed and in the mandrel 12 there are 2-6, advantageously 3 openings 22 for melt feed. In the nozzle assembly 10 the nozzle 11 and the cooler 15 have a press-on fit abutment for fastening them to each other. Also the nozzle 11 and the mandrel 12 have a press-on fit abutment for fastening them to each other. To ensure the abutment between the nozzle 11 and the mandrel 12*a* locking pin 25 may be provided. The mandrel 12 is conical and its angle of point is 0.5-3°, advantageously 2°. The nozzle 11 is tubular and the thickness of the wall in the cooling zone is 0.5-4.0 mm, more advantageously 1.0-2.0 mm. The conical mandrel 12 is tubular and thickness of the wall is 0.5-10 mm, more advantageously 2-4 mm. According to an advantageous feature the cooler 15 of the nozzle assembly 10 is made of graphite or other ceramic material and the cooling zone has length of 40-400 mm, advantageously 80 mm.

REFERENCE SIGNS USED IN THE DRAWING

10 nozzle assembly
11 nozzle
12 mandrel
13 protective pot
14 isolator
15 cooler
16 cooling liquid space
Z dwindling area

The invention claimed is:

1. A continuous casting nozzle assembly for upward vertical casting of a non-ferrous pipe, said assembly being suitable for uninterrupted casting and comprising:

a tubular nozzle having a feed end, an outlet end, and an inner surface, a mandrel locating inside the feed end of the tubular nozzle, and a cooler locating around the outlet end of the nozzle and having a cooling liquid space forming a cooling zone, wherein a dwindling area of the inner surface of the nozzle where cast pipe begins to dwindle locates at beginning of the cooling zone and at least part of the dwindling area of an inner surface of the nozzle has a roughness of 3-5 Ra.

2. The continuous casting nozzle assembly according to claim 1, wherein the surface roughness of the inner surface of the nozzle is 3-5 Ra upwards of a point at which a cross-section of a continuously cast pipe begins to dwindle because of casting contraction at the dwindling area located at a point where the cooler begins to have an effect on melt.

3. The continuous casting nozzle assembly according to claim 1, wherein the nozzle includes tangential openings for melt feed in the nozzle, said tangential openings arranged at an upward angle of 0-45°.

4. The continuous casting nozzle assembly according to claim 1, wherein the mandrel includes tangential openings for melt feed, said tangential openings arranged at an upward angle of 0-80°.

5. The continuous casting nozzle assembly according to claim 4, wherein the nozzle includes tangential openings for melt feed in the nozzle, said tangential openings in the nozzle arranged at an upward angle of 0-45°, and wherein the tangential openings in the mandrel have a diameter which is greater than a diameter of the tangential openings in the nozzle.

6. The continuous casting nozzle assembly according to claim 1, wherein the nozzle includes between 2-6 openings for melt feed and that the mandrel includes between 2-6 openings for melt feed.

7. The continuous casting nozzle assembly according to claim 1, wherein the mandrel is conical having an angle of point is between 0.5-3° and wherein the mandrel is tubular with wall thickness of 0.5-10 mm.

8. The continuous casting nozzle assembly according to claim 1, wherein the nozzle is tubular and has a wall thickness of 0.5-4.0 mm.

9. The continuous casting nozzle assembly according to claim 1, wherein the cooler is made of graphite or other ceramic material and wherein the assembly further comprises a cooling zone having a length of 40-400 mm.

10. The continuous casting nozzle assembly according to claim 1, further comprising an isolating part located at bottom of the mandrel.

11. The continuous casting nozzle assembly according to claim 1, wherein the total length of the nozzle is 100-300 mm and the total length of the mandrel is 20-30% less than said total length of the nozzle.

12. The continuous casting nozzle assembly according to claim 1, wherein the nozzle and the cooler have a press-on fit abutment for fastening them to each other and that the nozzle and the mandrel have a press-on fit abutment for fastening them to each other.

13. The continuous casting nozzle assembly according to claim 1, further comprising a protective pot, an isolator and a cooling liquid space.

* * * * *